US008210525B2

(12) United States Patent
Ushiyama

(10) Patent No.: US 8,210,525 B2
(45) Date of Patent: Jul. 3, 2012

(54) IMAGE FORMING APPARATUS AND LATERAL DISPLACEMENT DETECTION METHOD

(75) Inventor: Yousuke Ushiyama, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/884,124

(22) Filed: Sep. 16, 2010

(65) Prior Publication Data

US 2011/0074101 A1 Mar. 31, 2011

Related U.S. Application Data

(60) Provisional application No. 61/246,645, filed on Sep. 29, 2009.

(51) Int. Cl.
*B65H 1/00* (2006.01)
*B65H 9/00* (2006.01)

(52) U.S. Cl. ..... 271/171; 271/240

(58) Field of Classification Search ..... 271/171, 271/145, 240; 74/89.11, 89.12, 422
See application file for complete search history.

(56) References Cited

U.S. PATENT DOCUMENTS

| | | | | |
|---|---|---|---|---|
| 5,148,228 | A * | 9/1992 | Takano | 399/400 |
| 5,332,208 | A * | 7/1994 | Tsuji et al. | 271/171 |
| 5,826,156 | A * | 10/1998 | Natsume et al. | 399/389 |
| 6,070,048 | A * | 5/2000 | Nonaka et al. | 399/376 |
| 6,454,254 | B2 * | 9/2002 | Yamaguchi et al. | 271/171 |
| 7,845,632 | B2 * | 12/2010 | Windsor et al. | 271/171 |
| 2009/0066011 | A1 * | 3/2009 | Ohno et al. | 271/171 |
| 2011/0127714 | A1 * | 6/2011 | Kuo | 271/171 |

FOREIGN PATENT DOCUMENTS

| | | |
|---|---|---|
| JP | 06-234432 | 8/1994 |
| JP | 08-012135 | 1/1996 |
| JP | 11-292347 | 10/1999 |

* cited by examiner

*Primary Examiner* — Stefanos Karmis
*Assistant Examiner* — Patrick Cicchino
(74) *Attorney, Agent, or Firm* — Patterson & Sheridan, LLP

(57) ABSTRACT

According to one embodiment, a sheet stacker includes a stacking table, a pair of side walls, and a sensor. The stacking table is configured to stack a sheet. The pair of side walls is configured to move symmetrically with respect to a center position to regulate both sides of the sheet in a width direction. The sensor is configured to detect a relative position of the center position against the stacking table.

19 Claims, 11 Drawing Sheets

IMAGE FORMING APPARATUS AND LATERAL DISPLACEMENT DETECTION METHOD

CROSS-REFERENCE TO RELATED APPLICATIONS

This application is based upon and claims the benefit of priority from Provisional Application No. 61/246,645 filed on Sep. 29, 2009, the entire contents of which are incorporated herein by reference.

FIELD

Embodiments described herein relate generally to a sheet stacker to adjust the stacked position of a sheet.

BACKGROUND

An image forming apparatus matches an image formed by an image forming unit with a fed and conveyed sheet in the width direction and performs an image forming process. A sheet conveyance path in the image forming apparatus and a conveyance path of a finisher, as an option, connected thereto are required to be matched with each other in the sheet width direction. A sheet cassette includes an adjustment mechanism by which the user adjusts the center position in the sheet width direction.

The sheet cassette includes for example two side walls to slide through a pinion gear and to regulate both sides of a sheet. A pinion holder rotatably holds the pinion. The pinion holder regulates the position of the sheet cassette with respect to a housing in the sheet width direction. The user adjusts the position of the pinion holder, and fixes the pinion holder to the housing by a screw or the like.

When the user strongly inserts the sheet cassette into the image forming apparatus, an impact force is transmitted to the pinion gear. There is a possibility that the position of the pinion gear is displaced in an adjustable area.

When the position of the pinion gear is displaced, the center position of the sheet stacked on the sheet cassette in the width direction varies from the initial position. In the image forming apparatus, the accuracy of the print position with respect to the sheet is degraded or the sheet is caught during conveyance and a jam can occur. However, before the abnormality as stated above occurs in the image forming process, the user can not easily recognize that the position of the pinion gear is displaced by some influence.

DETAILED DESCRIPTION

In general, according to one embodiment, a sheet stacker includes a stacking table, a pair of side walls, and a sensor. The stacking table is configured to stack a sheet. The pair of side walls is configured to move symmetrically with respect to a center position to regulate both sides of the sheet in a width direction. The sensor is configured to detect a relative position of the center position against the stacking table.

Figure 1:
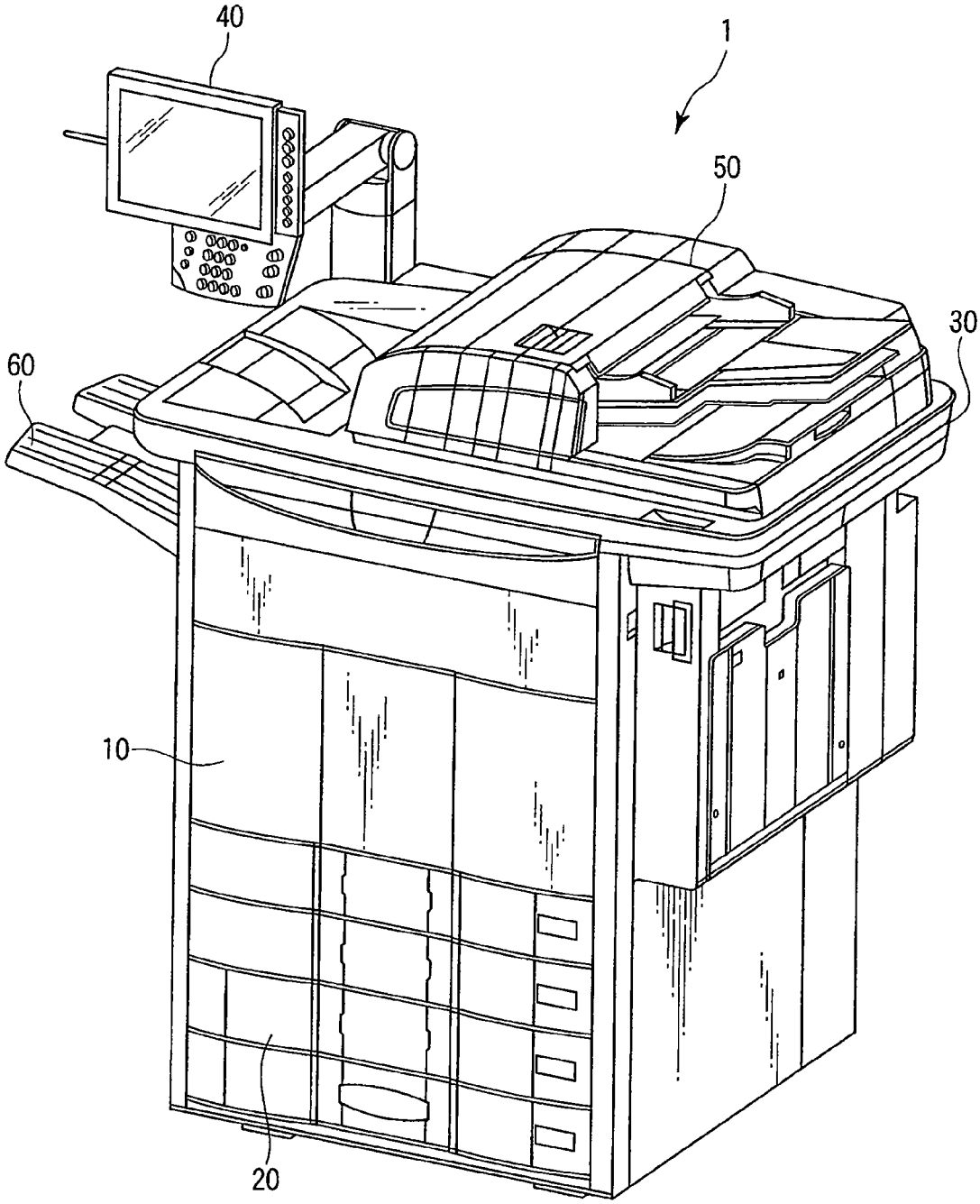
FIG. 1 is an exemplary schematic view showing an outer appearance of an image forming apparatus according to a first embodiment.

FIG. 1 is a perspective view showing an outer appearance of an image forming apparatus 1 in a first embodiment. The image forming apparatus 1 includes an image forming unit 10, a sheet conveying device 20, a scanner 30, a control panel 40, an auto document feeder 50, and a storage tray 60. The image forming unit 10 is at the center of the image forming apparatus 1. The image forming unit 10 outputs image information as an output image called, for example, a hard copy or printout. The sheet conveying device 20 is below the image forming unit 10. The sheet conveying device 20 supplies a sheet of an arbitrary size used for image output to the image forming unit 10.

The scanner 30 is above the image forming apparatus 1. The scanner 30 captures image information as image data, which is as an object of image formation in the image forming unit 10, from a document. The control panel 40 is above the image forming apparatus 1. The control panel 40 has an input function to input a start of image formation in the image forming unit 10 or a start of reading of image information of a document by the scanner 30. The control panel 40 has a display function to display various messages to a user.

The auto document feeder 50 opens and closes with respect to the scanner 30. The auto document feeder 50 reads the image information from the document and discharges the document from the read position to the discharge position, and guides a next document to the read position. The storage tray 60 is on the side surface of the image forming apparatus 1. The storage tray 60 stacks the sheet on which the image forming unit 10 forms the image.

Figure 2:
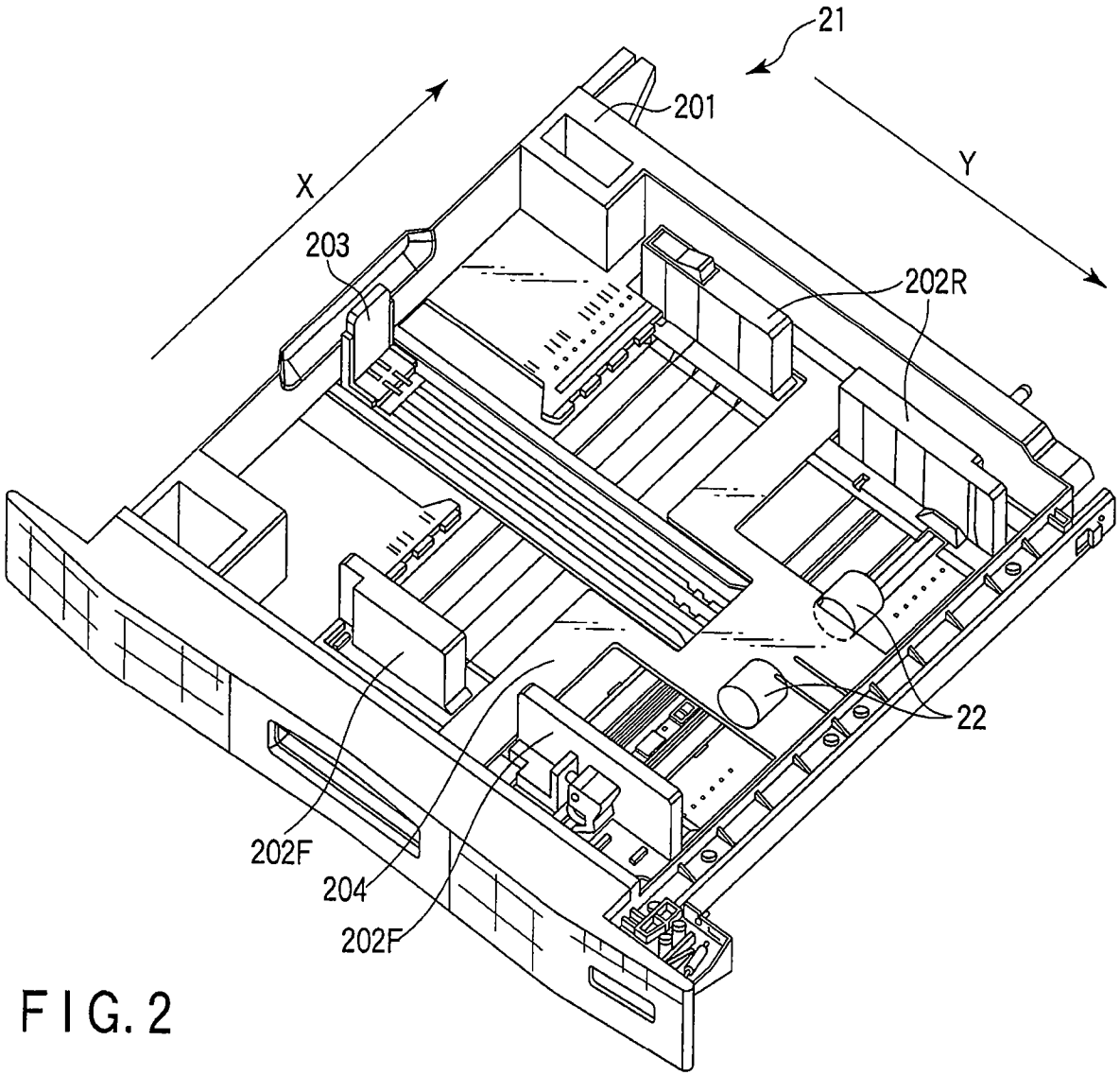
FIG. 2 is an exemplary upper perspective view of a sheet cassette according to the first embodiment.

FIG. 2 is upper perspective view of a sheet cassette 21 attached to and detached from the sheet conveying device 20 in the first embodiment. An arrow X denotes an attachment direction of the sheet cassette 21 to the sheet conveying device 20. The sheet conveying device 20 includes a paper feed roller 22. The paper feed roller 22 is located at a position where the paper feed roller 22 contacts with the upper surface of a sheet bundle stacked on the sheet cassette 21 when the user mounts the sheet cassette 21 to the sheet conveying device 20. The paper feed roller 22 conveys a sheet one by one from the upper surface of the sheet bundle stacked on the sheet cassette 21 to the image forming unit 10. The paper feed roller 22 conveys the sheet in a Y direction perpendicular to the X direction in which the user mounts the sheet cassette 21 to the sheet conveying device 20.

The sheet cassette 21 includes a housing 201, a front-side side wall 202F, a rear-side side wall 202R, an end wall 203, and a pressure plate 204. The housing 201 is box-shaped, and contains sheets stacked in the inside thereof. The housing 201 stacks the sheet so that the X direction is coincident with the sheet width direction, and the Y direction is coincident with the longitudinal direction of the sheet. The front-side side wall 202F contacts with the side surface, at one end side (near side in the insertion direction of the sheet cassette 21 into the image forming apparatus 1), of the sheet bundle stacked on the sheet cassette 21. The front-side side wall 202F moves back and forth in the X direction, and regulates the position of the sheet in the width direction. Similarly, the rear-side side wall 202R contacts with the side surface, at the other end side (back side in the insertion direction of the sheet cassette 21 into the image forming apparatus 1), of the sheet bundle stacked on the sheet cassette 21. The rear-side side wall 202R moves back and forth in the X direction, and regulates the position of the sheet in the width direction.

The end wall 203 contacts with the surface of the sheet bundle at the trailing edge side of the sheet in the conveyance direction by the paper feed roller 22. The end wall 203 moves back and forth in the Y direction, and regulates the position of the sheet in the longitudinal direction. The pressure plate 204 contacts with the lowermost surface of the sheet bundle stacked on the housing 201. The pressure plate 204 pushes up the whole sheet bundle to the paper feed roller 101 from the bottom of the housing 201 to ensure the conveyance of the sheet by the paper feed roller 22.

Figure 3:
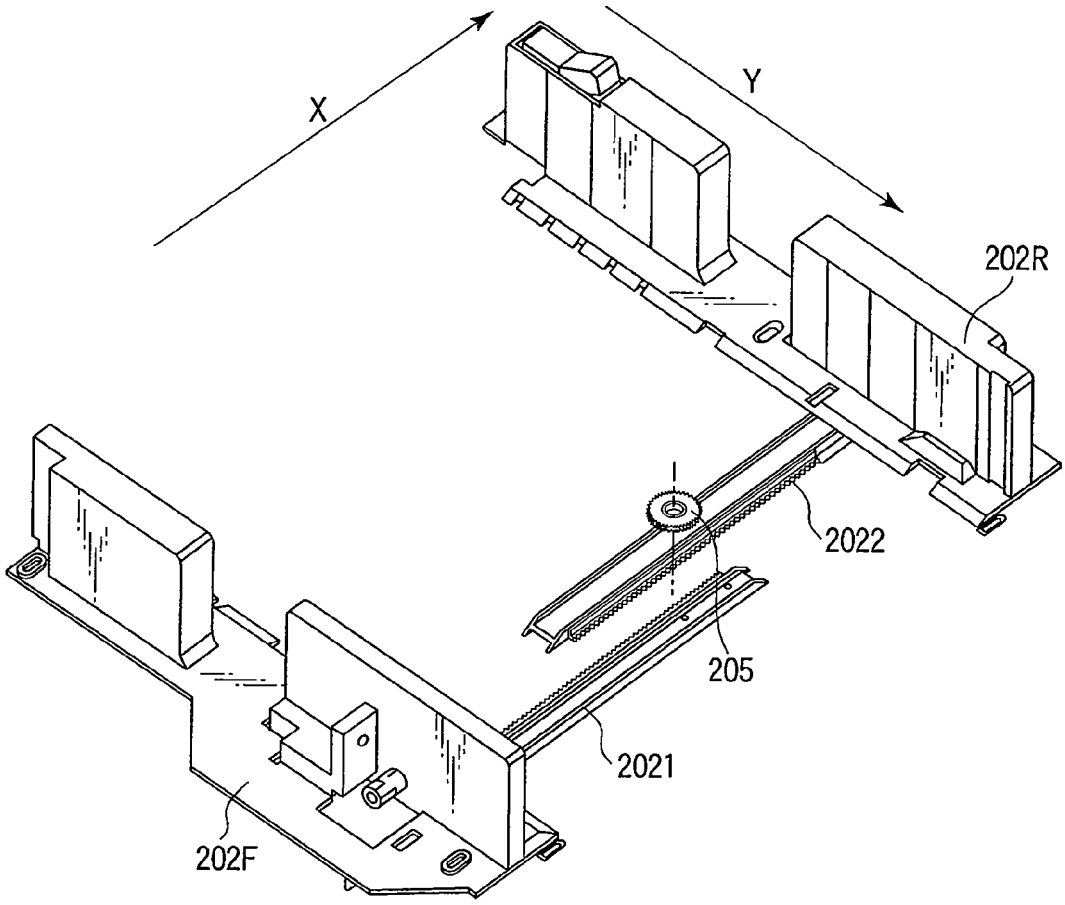
FIG. 3 is an exemplary upper perspective view in which a structure of the sheet cassette according to the first embodiment is exploded and shown.

FIG. 3 is an upper perspective view in which a part of a structure of the sheet cassette 21 in the first embodiment is exploded and shown. The front-side side wall 202F includes a front-side rack portion 2021 in the X direction. Similarly, the rear-side side wall 202R includes a rear-side rack portion 2022 in the X direction. The front-side rack portion 2021 and the rear-side rack portion 2022 separate form each other in parallel. The front-side rack portion 2021 and the rear-side rack portion 2022 respectively include teeth along the X direction at the same pitch on the sides opposite to each other. A pinion gear 205 is between the front-side rack portion 2021 and the rear-side rack portion 2022. The teeth on the outer peripheral surface of the pinion gear 205 have the same pitch as the teeth of the front-side rack portion 2021 and the rear-side rack portion 2022. The pinion gear 205 engages with the front-side rack portion 2021 and the rear-side rack portion 2022.

Figure 4:
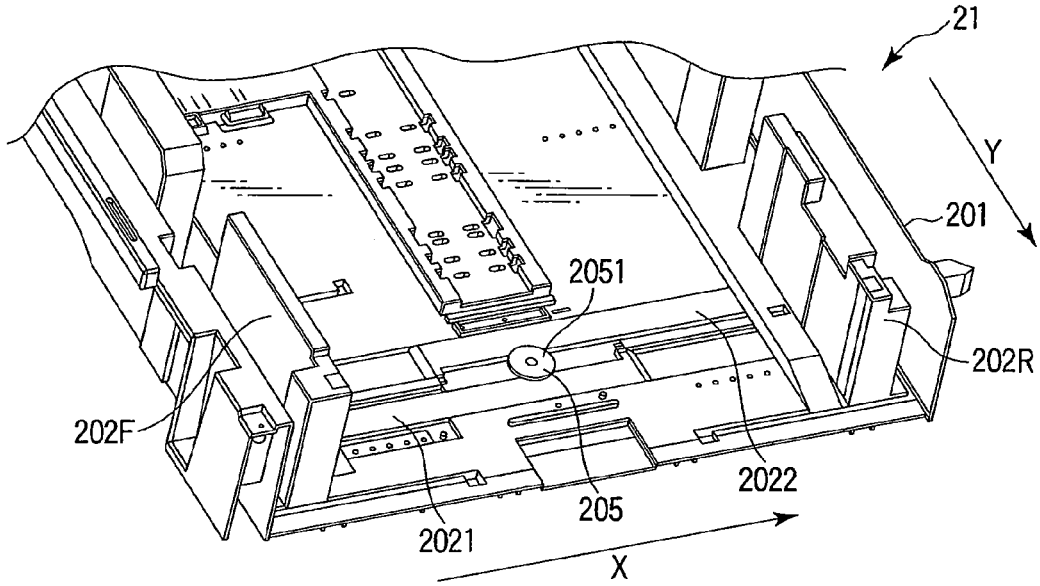
FIG. 4 is an exemplary upper perspective view of the sheet cassette according to the first embodiment.

FIG. 4 is an upper perspective view of the sheet cassette 21 showing a state where the front-side side wall 202F, the rear-side side wall 202R and the pinion gear 205 shown in FIG. 3 are in the housing 201. The pinion gear 205 moves back and forth in the X direction by a pitch of, for example, 1.0 mm. The front-side side wall 202F and the rear-side side wall 202R move back and forth by the same distance in the X direction while the pinion gear 205 is the center. The front-side side wall 202F and the rear-side side wall 202R slide in the X direction through the pinion gear 205. The front-side side wall 202F and the rear-side side wall 202R regulate the position of the sheet in the width direction in the housing 201. When the position of the pinion gear 205 is displaced, the center position in the sheet width direction in the housing 201 (hereinafter simply called the center position) is also displaced. The center position is an axis passing through the pinion gear 205 in the Y direction.

Figure 5:
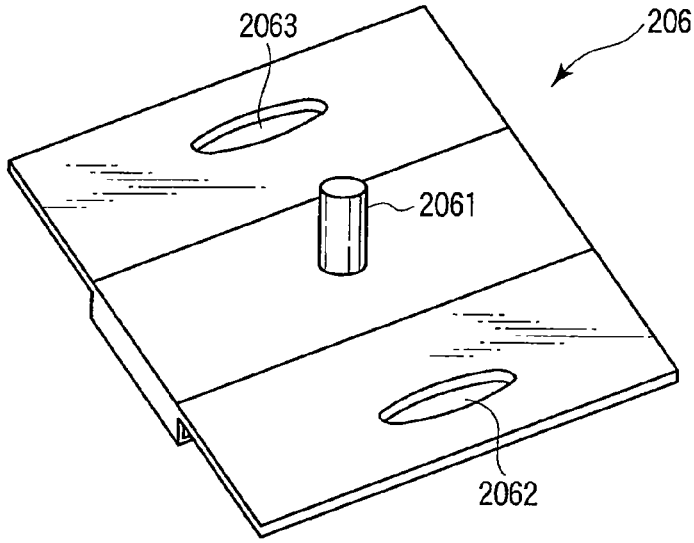
FIG. 5 is an exemplary perspective view of a pinion holder according to the first embodiment.
Figure 6:
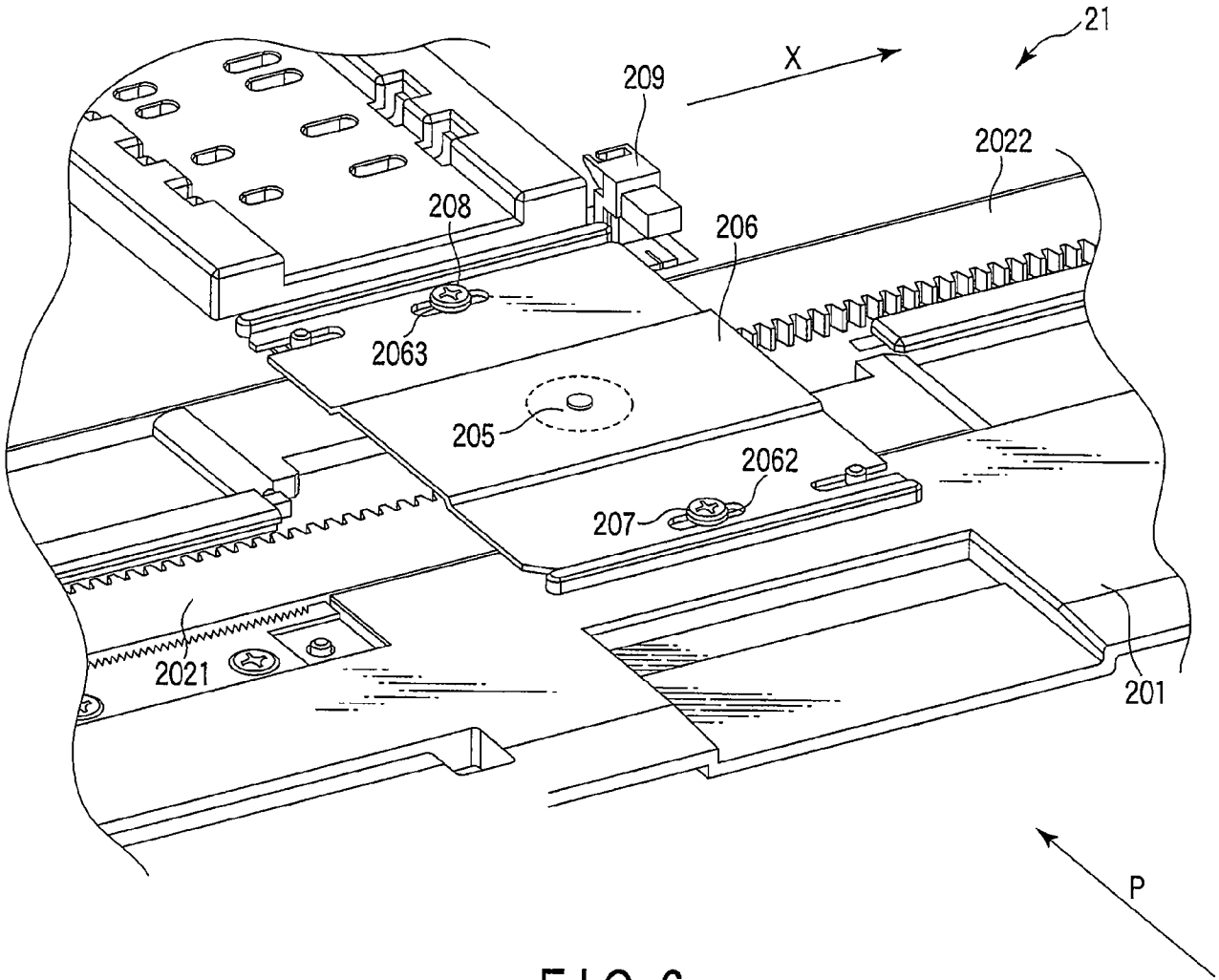
FIG. 6 is an exemplary upper perspective view of the sheet cassette according to the first embodiment.

FIG. 5 is a perspective view in which a pinion holder (gear holder) 206 is seen from a side opposite to the housing 201. FIG. 6 is an upper perspective view of the sheet cassette 21 enlarging and showing a state where the user fixes the pinion holder 206 to the housing 201. The pinion holder 206 covers the upper surface of the pinion gear 205 to position the pinion gear 205 relative to the housing 201. The pinion holder 206 includes a projection 2061, an opening 2062 and an opening 2063.

As shown in FIG. 4, the projection 2061 fits in an opening 2051 at the center of the pinion gear 205. The diameter of the projection 2061 is smaller than the diameter of the opening 2051. The pinion gear 206 rotates around the projection 2061. A screw 207 fixes the pinion holder 206 to the housing 201 through the opening 2062. Similarly, a screw 208 fixes the pinion holder 206 to the housing 201 through the opening 2063. Although FIG. 6 shows the two screws and the two openings of the pinion holder, the number of the screws and that of the openings are not limited. The pinion holder 206 changes the position relative to the housing 201 according to the displacement of the position of the pinion gear 205. The displacement of the position of the pinion gear 205 and the pinion holder 206 relative to the housing 201 includes the user's intentional adjustment. The displacement of the position of the pinion gear 205 and the pinion holder 206 relative to the housing 201 includes the user's unintentional lateral displacement due to the weight of the sheet bundle and the magnitude of the force applied by the user when the user inserts the sheet cassette 21 into the image forming apparatus 1 or extracts the sheet cassette 21 from the image forming apparatus 1.

The housing 201 includes a photo interrupter sensor 209. The photo interrupter sensor 209 detects the presence or absence of an object. In the first embodiment, the photo interrupter sensor 209 detects the presence or absence of the pinion holder 206. The photo interrupter sensor 209 detects the lateral displacement of the center position by detecting the presence or absence of the pinion holder 206. The position of the photo interrupter sensor 209 moves back and forth in the X direction according to the adjustment amount of the center position. The pinion gear 205, the pinion holder 206, the photo interrupter sensor 209, the front-side rack portion 2021, and the rear-side rack portion 2022 are in the housing 201 below the pressure plate 204 shown in FIG. 2.

Figure 7:
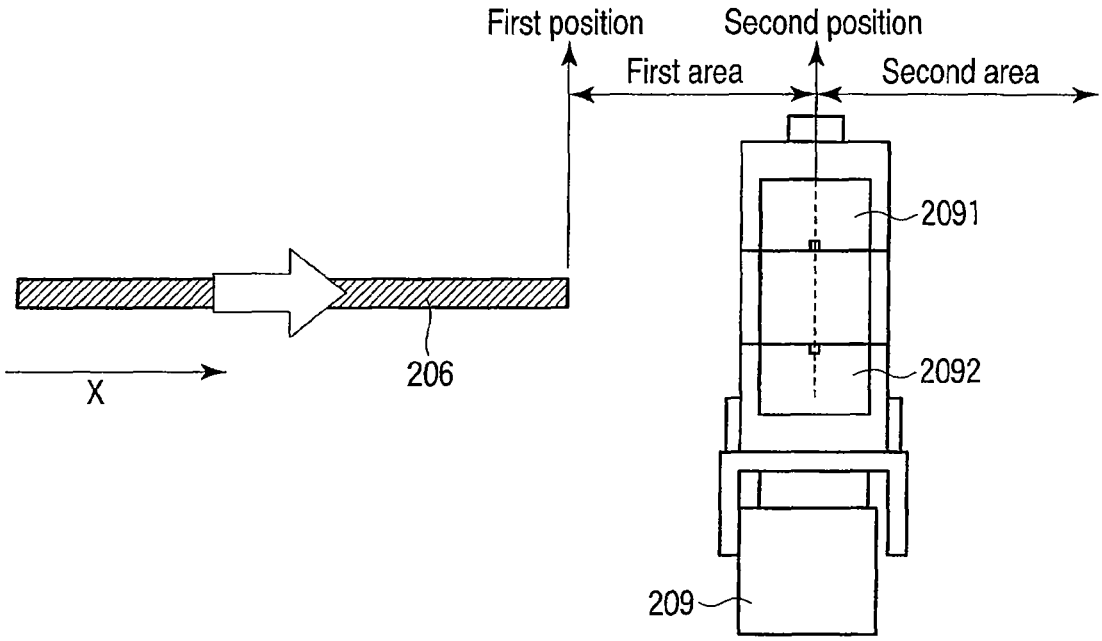
FIG. 7 is an exemplary plan view of the sheet cassette according to the first embodiment seen in an arrow P direction shown in FIG. 6.

FIG. 7 is a plan view in which the housing 201 shown in FIG. 6 is seen in an arrow P direction. The arrow P direction is opposite to the Y direction. The housing 201 includes the pinion holder 206 fixed by the screws 207 and 208 to the housing 201 after the user adjusts the center position. The position of an end (hereinafter simply referred to as an end of the pinion holder 206) of the pinion holder 206 at the photo interrupter sensor 209 side when the user fixes the pinion holder 206 to the housing 201 is a first position. The photo interrupter sensor 209 is at a position separate in the X direction from the end of the pinion holder 206 at the first position. The setting position of the photo interrupter sensor 209 is a second position. An area between the first position and the second position is a first area. The user sets the first area.

In general, when the user inserts the sheet cassette 21 into the image forming apparatus 1 or extracts the sheet cassette 21 from the image forming apparatus 1, various influences applied a force to the pinion holder 206. Thus, there is a possibility that the pinion holder 206 is slightly displaced in the X direction. The first area is the area where even if the end of the pinion holder 206 enters by the lateral displacement of the center position, the image forming apparatus 1 can normally start the image forming operation. The user sets the first area within a range where a disadvantage does not occur from, for example, a relation between an image formed on a sheet through a photoreceptor and a margin of the sheet, or a relation between a sheet conveyance path in the image forming apparatus 1 and a conveyance path of a finisher, as an option, connected thereto. An area separating from the second position in the X direction is a second area. The second area is the area where when the end of the pinion holder 206 enters by the lateral displacement of the center position, the image forming apparatus 1 can not normally start the image forming operation.

The photo interrupter sensor 209 includes a light emitting portion 2091 and a light receiving portion 2092 separate from each other in the height direction. The photo interrupter sensor 209 detects the pinion holder 206 when the pinion holder 206 shields between the light emitting portion 2091 and the light receiving portion 2092. When the end of the pinion holder 206 is in the first area, the photo interrupter sensor 209 does not detect the pinion holder 206. On the other hand, when the end of the pinion holder 206 is in the second area by the lateral displacement, the photo interrupter sensor 209 detects the pinion holder 206. On the other hand, when the end of the pinion holder 206 is in the first area, the photo interrupter sensor 209 may detect that the end of the pinion holder 206 is not in the second area. In this case, when the end of the pinion holder 206 is in the second area by the lateral displacement, the photo interrupter sensor 209 does not detect that the end of the pinion holder 206 is not in the second area.

Figure 8:
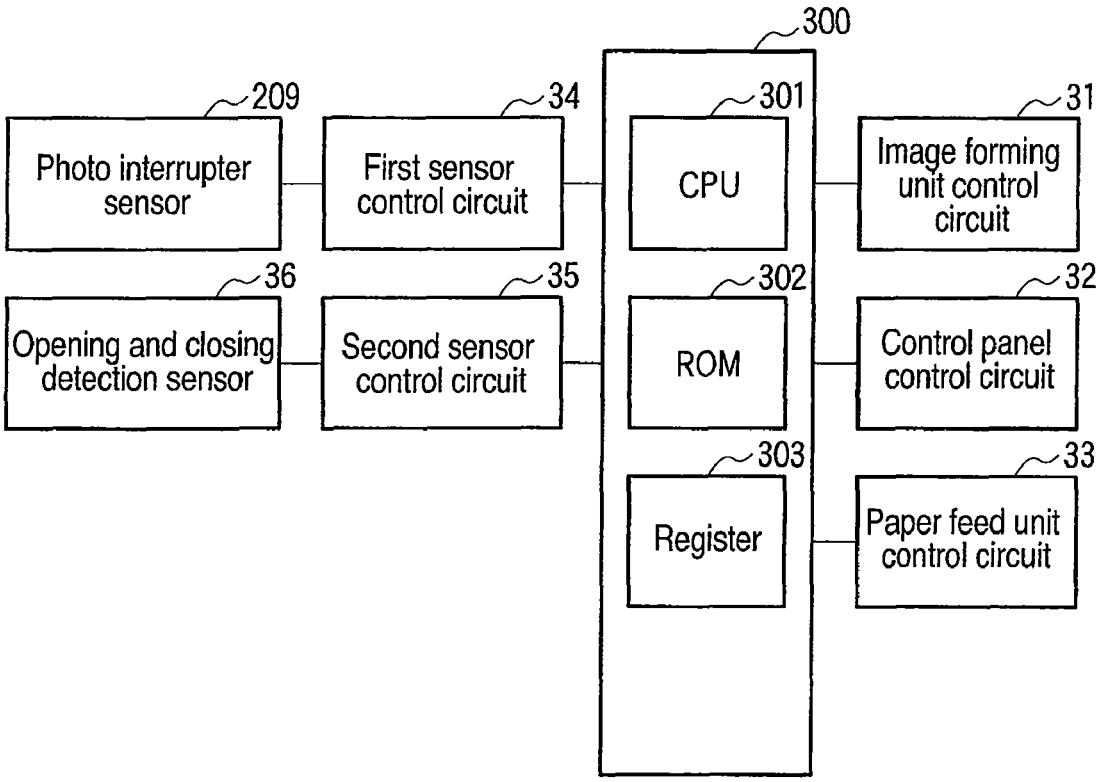
FIG. 8 is an exemplary block diagram showing a control system of the image forming apparatus according to the first embodiment.

FIG. 8 is a block diagram showing a control system of the image forming apparatus 1 in the first embodiment. The image forming apparatus 1 includes a main controller 300, an image forming unit control circuit 31, a control panel control circuit 32, a paper feed control circuit 33, a first sensor control circuit 34, a second sensor control circuit 35, and an opening and closing detection sensor 36. The main controller 300 includes a CPU 301, a ROM 302 and a register (memory) 303. The CPU 301 controls respective parts based on control information previously stored in the ROM 302. The register 303 temporarily stores necessary information.

The image forming unit control circuit 31 controls the image formation operation of the image forming unit 10. The control panel control circuit 32 controls the display of a message on the control panel 40 and the input of the user. The paper feed unit control circuit 33 controls the sheet conveyance of the paper feed roller 22. The first sensor control circuit 34 controls the operation of the photo interrupter sensor 209. The second sensor control circuit 35 controls the operation of the opening and closing detection sensor 36. The opening and closing detection sensor 36 detects the opening and closing of the sheet cassette 21 (insertion into the image forming apparatus 1 and extraction from the image forming apparatus 1). The state where the user inserts the sheet cassette 21 into the image forming apparatus 1 is the closed states. The state where the user extracts the sheet cassette 21 from the image forming apparatus 1 is the open state.

Figure 9:
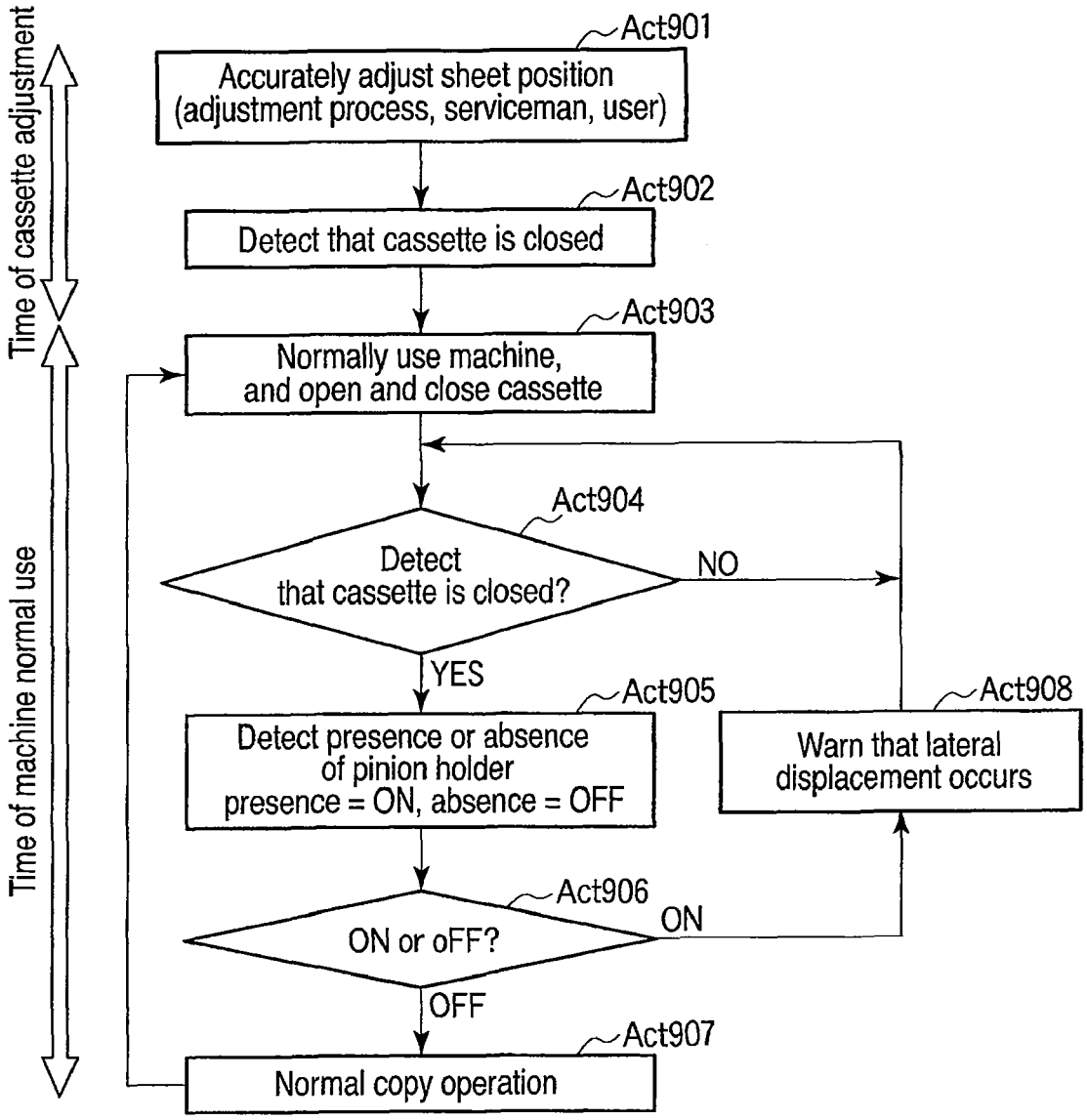
FIG. 9 is an exemplary view showing a flow of lateral displacement detection of a center position according to the first embodiment.

FIG. 9 is a view showing a flow of lateral displacement detection of the center position in the first embodiment. First, a serviceman or a user accurately adjusts a sheet position as an adjustment process (Act 901). The serviceman or the user may move the position of the pinion gear 205 and the pinion holder 206, and accurately adjusts the center position. Thereafter, the serviceman or the user brings the sheet cassette 21 into the closed state.

The image forming apparatus 1 detect that the cassette is closed (Act 902). The CPU 301 may use the opening and closing detection sensor 36 and detects that the sheet cassette 21 whose center position is at the first position is in the closed state. The flow may concern with a cassette adjustment of the sheet cassette 21.

The flow may concern with a machine normal use of the image forming apparatus 1. The user normally uses the machine, and opens and closes the cassette (Act 903). The user may normally use the image forming apparatus 1, and opens and closes the sheet cassette 21 for sheet supply or the like. The image forming apparatus 1 detects that the cassette is closed (Act 904). At the time of normal use, the CPU 301 uses the opening and closing detection sensor 36 and detects that the sheet cassette 21 is in the closed state. The CPU 301 polls the opening and closing detection sensor 36 until the sheet cassette 21 detects the closed state (No at Act 904).

When the image forming apparatus 1 detects that the cassette is closed (YES at Act 904), the image forming apparatus 1 detects the presence or absence of the pinion holder. The image forming apparatus 1 sets the presence of the pinion holder to be ON and sets the absence of the pinion holder to be OFF (Act 905). The photo interrupter sensor 209 may detect the presence or absence of the end of the pinion holder 206 in the second area. When detecting the pinion holder 206 in the second area, the photo interrupter sensor 209 turns ON the signal to be outputted to the CPU 301. When not detecting the pinion holder 206 in the second area, the photo interrupter sensor 209 turns OFF the signal to be outputted to the CPU 301. The signal to be outputted to the CPU 301 by the photo interrupter sensor 209 is detection information of the pinion holder 206.

The image forming apparatus 1 determines whether the signal is ON or OFF (Act 906). The CPU 301 may determine whether the signal from the photo interrupter sensor 209 is ON or OFF. The image forming unit 10 controls the propriety of the image forming operation based on the lateral displacement amount of the center position. The image forming unit 10 controls the propriety of the image forming operation when the user opens or closes the sheet cassette 21 at the time of the machine normal use. The image forming unit 10 controls the propriety of the image forming operation when the photo interrupter sensor 209 detects the presence or absence of the pinion holder 206 in the second area.

When the image forming apparatus 1 determines that signal is OFF (OFF at Act 906), the image forming apparatus 1 performs a normal copy operation (Act 907). When the end of the pinion holder 206 is in the first area, the CPU 301 may control the image forming unit 10 to perform the normal copy operation (image forming operation). The image forming unit 10 performs the image forming operation.

On the other hand, when the image forming apparatus 1 determines that the signal is ON (ON at Act 906), the image forming apparatus 1 warns that the lateral displacement occurs (Act 908). When the pinion holder 206 may be in the second area, the CPU 301 controls so that the control panel 40 notifies that the pinion gear 206 enters the second area by the lateral displacement. The control panel 40 displays the propriety of the image forming operation of the image forming unit 10. The CPU 301 may control to warn by outputting the sound. The CPU 301 controls the image forming unit 10 not to perform the image forming operation.

The CPU 301 returns to Act 904, and the opening and closing detection sensor 36 proceeds with detecting whether the sheet cassette 21 is in the closed state at the time of normal use. The serviceman or the user brings the sheet cassette 21 into the open state, and again moves the position of the pinion gear 205 and the pinion holder 206 to correctly adjust the center position. The serviceman or the user corrects the lateral displacement of the center position, and then brings the sheet cassette 21 into the closed state.

Figure 10:
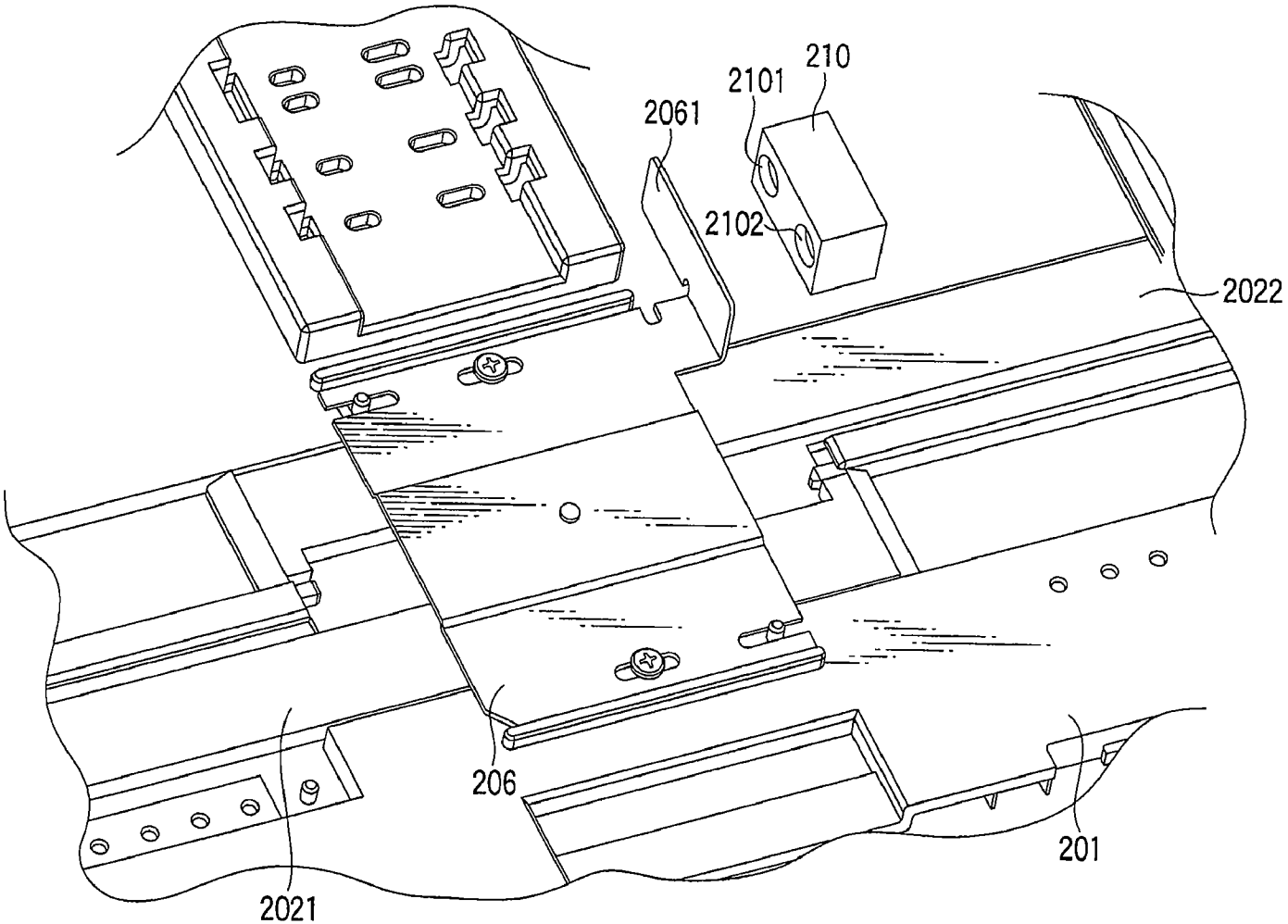
FIG. 10 is an exemplary upper perspective view of a sheet cassette according to a second embodiment.

A second embodiment is described. FIG. 10 is an upper perspective view of a sheet cassette 21 enlarging and showing a state where a pinion holder 206 is fixed to a housing 201. The same portion as that of the first embodiment is the same reference numeral. The second embodiment is an example in which instead of the photo interrupter sensor 209 described in the first embodiment, the housing 201 includes a distance measuring sensor 210. Incidentally, in the second embodiment, in FIG. 8, the first sensor control circuit 34 controls the operation of the distance measuring sensor 210. The distance measuring sensor 210 measures the distance from the pinion holder 206, and detects the lateral displacement of the center position.

The pinion holder 206 includes a tongue piece 2061 of sheet metal at an end in an X direction. The tongue piece 2061 includes a plane portion perpendicular to the X direction. The housing 201 includes the distance measuring sensor 210 at a fixed position. The distance measuring sensor 210 includes a light emitting portion 2101 and a light receiving portion 2102. The distance measuring sensor 210 emits light from the light emitting portion 2101 to the tongue piece 2061. The distance measuring sensor 210 receives the light reflected by the tongue piece 2061 by the light receiving portion 2102. The distance measuring sensor 210 measures the distance from the tongue piece 2061 based on the amount of the received light. The distance measuring sensor 210 outputs an output voltage corresponding to the measured distance to the CPU 301. The distance measuring sensor 210 is, for example, an infrared distance measuring sensor.

Figure 11:
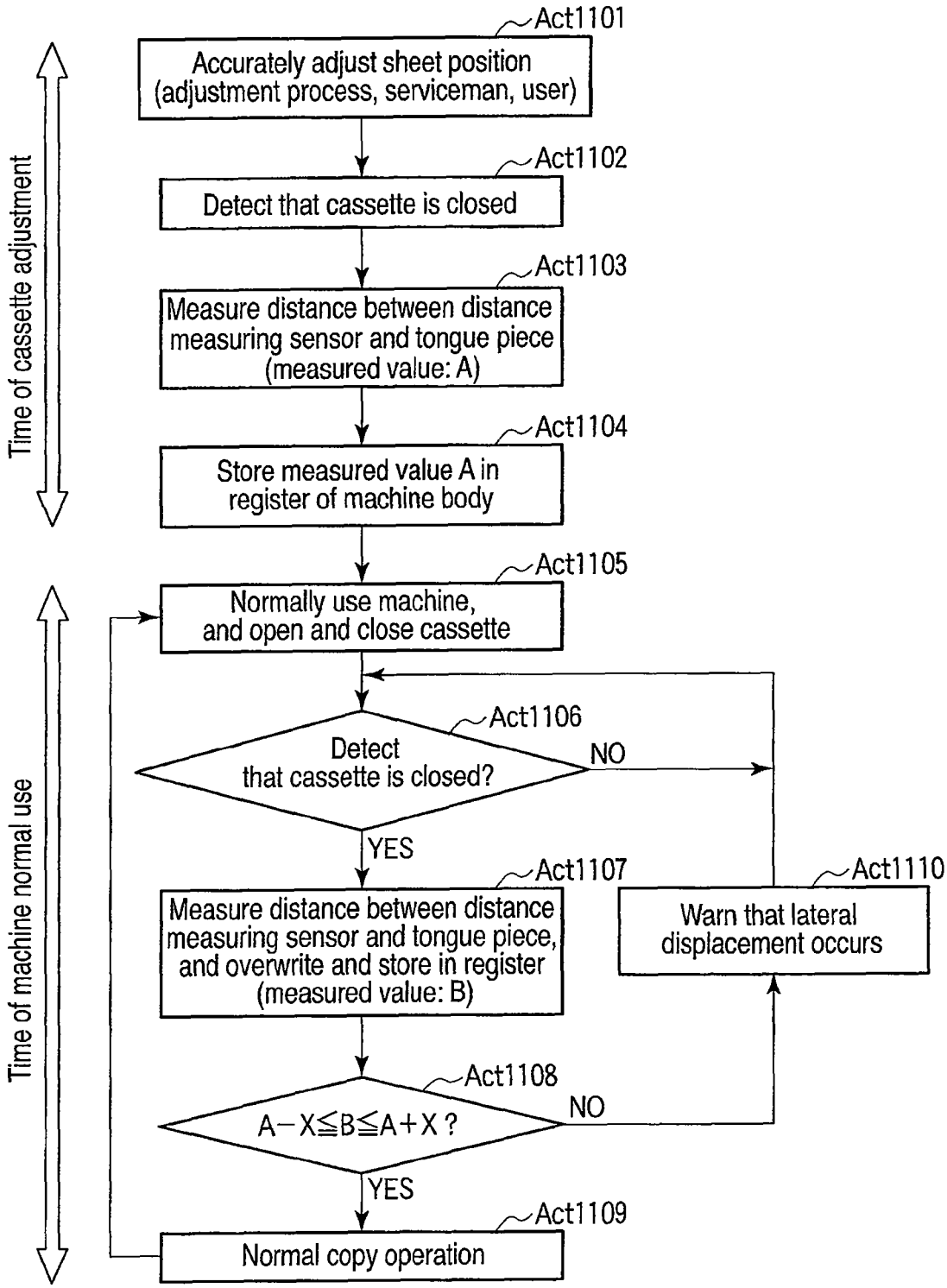
FIG. 11 is an exemplary view showing an example of a flow of lateral displacement detection of a center position according to the second embodiment.

FIG. 11 is a view showing a flow of lateral displacement detection of the center position in the second embodiment. First, a serviceman or a user accurately adjusts the sheet position as an adjustment process (Act 1101). Act 1101 may be the same as Act 901. The image forming apparatus 1 detects that the cassette is closed (Act 1102). Act 1102 may be the same as Act 902. The image forming apparatus 1 measures the distance between the distance measuring sensor and the tongue piece. The measured value is "A" (Act 1103). The distance measuring sensor 210 may measure the distance from the tongue piece 2061 by the light emitting portion 2101 and the light receiving portion 2102. The measured value "A" is the value measured by the distance measuring sensor 210 when the center position is at the correct position at the time of cassette adjustment. The measured value of the distance measuring sensor 210 is "A". The distance measuring sensor 210 outputs the output voltage corresponding to the measured value "A" (default value) to the CPU 301. The output voltage outputted to the CPU 301 by the distance measuring sensor 210 is detection information of the tongue piece 2061.

The image forming apparatus 1 causes the measured value "A" to be stored in a register of the machine body (Act 1104). The CPU 301 may cause the measured value "A" to be stored in a first area of a register 303. The flow may concern with an adjustment of the sheet cassette 21.

After this, the flow is at the time of machine normal use of the image forming apparatus 1. The user normally uses the machine, and opens and closes the cassette (Act 1105). Act 1105 may be the same as Act 903. The image forming apparatus 1 detects that the cassette is closed (Act 1106). Act 1106 may be the same as Act 904.

The image forming apparatus 1 measures the distance between the distance measuring sensor and the tongue piece, and overwrites and stores in the register. The measured value is "B" (Act 1107). The distance measuring sensor 210 may measure the distance from the tongue piece 2061 at the time of machine normal use. The measured value by the distance measuring sensor 210 is "B". The measured value "B" is the value measured by the distance measuring sensor 210 each time the user opens and closes the sheet cassette 21 at the time of normal use of the image forming apparatus 1 after the distance measuring sensor 210 measures the measured value "A". The distance measuring sensor 210 outputs the output voltage corresponding to the measured value "B" to the CPU 301. The CPU 301 causes the measured value "B" to be stored in a second area of the register 303. When the second area of the register 303 already stores a measured value, the CPU 301 overwrites the measured value with the measured value "B" and stores the measured value "B".

The image forming apparatus 1 determines whether the condition of $$A-X \leqq B \leqq A+X \qquad \text{equation (1)}$$

is satisfied (Act 1108). The CPU 301 may compare the measured value "B" stored in the register 303 with the measured value "A". The CPU 301 determines whether the condition of equation (1) is satisfied. "X" in equation (1) denotes a value obtained by converting the distance of the first area set by the user into the output voltage value in the distance measuring sensor 210. The image forming unit 10 controls the propriety of the image forming operation based on the lateral displacement amount of the center position. At the time of machine normal use, the image forming unit 10 controls the propriety of the image forming operation when the user opens and closes the sheet cassette 21. The image forming unit 10 controls the propriety of the image forming operation when the distance measuring sensor 210 measures the distance from the tongue piece 2061.

When the image forming apparatus 1 determines that the condition of equation (1) is satisfied (Yes at Act 1108), the image forming apparatus 1 performs the normal copy operation (Act 1109). Act 1109 may be the same as Act 907. When the image forming apparatus 1 determines that the condition of equation (1) is not satisfied (No at Act 1108), the image forming apparatus 1 warns that the lateral displacement occurs (Act 1110). Act 1110 may be the same as Act 908. The CPU 301 returns to Act 1106, and the opening and closing detection sensor 36 proceeds with detecting whether the sheet cassette 21 is in the closed state at the time of normal use. For example, the distance measuring sensor 210 again measures the distance from the tongue piece 2061 at Act 1107. The measured value by the distance measuring sensor 210 is B'. The distance measuring sensor 210 outputs an output voltage corresponding to the measured value B' to the CPU 301. The CPU 301 overwrites the measured value B with the measured value B' and stores the measured value B' in the second area of the register 303.

Figure 12:
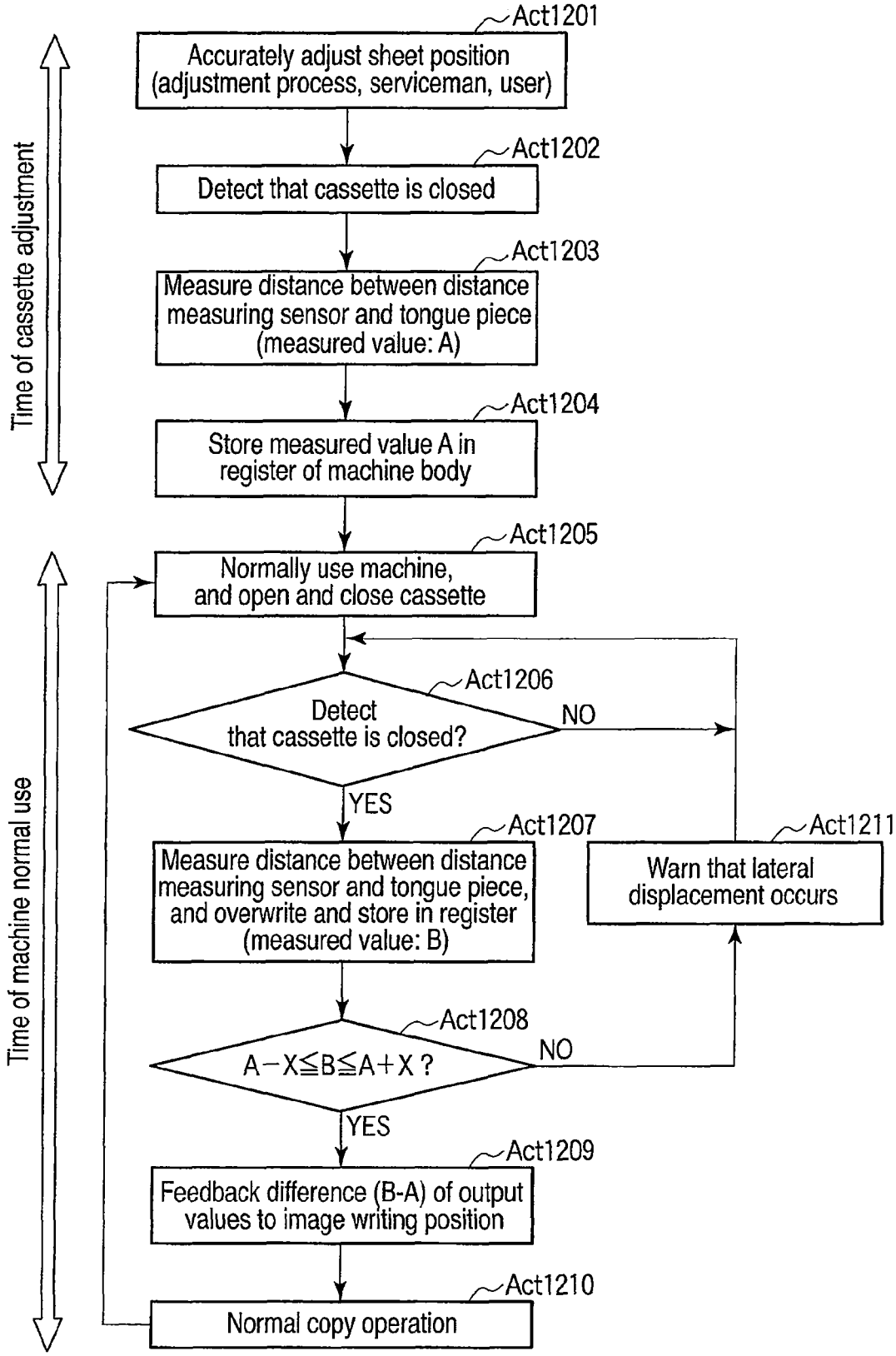
FIG. 12 is an exemplary view showing another example of the flow of the lateral displacement detection of the center position according to the second embodiment.

FIG. 12 is a flowchart showing another example of the lateral displacement detection of the center position in the second embodiment. Act 1201 to Act 1208 and Act 1211 may be the same as Act 1101 to Act 1108 and Act 1110 shown in FIG. 11. The example shown in FIG. 12 is different from the example shown in FIG. 11 in that when the image forming apparatus 1 determines that the condition of equation (1) is satisfied (YES at Act 1208), the image forming apparatus 1 performs a process of Act 1209 described below.

When the image forming apparatus 1 determines that the condition of equation (1) is satisfied (YES at Act 1208), the image forming apparatus 1 feedbacks the difference (B−A) of output values to an image writing position (Act 1209). The CPU 301 may control the image forming unit 10 to feedback the lateral displacement amount as the difference (B−A) of the output values of the distance measuring sensor 210 to the image writing position in the sheet width direction. Thereafter, the image forming apparatus 1 performs the normal copy operation (Act 1210). The CPU 301 may control the image forming unit 10 to set the position corresponding to the lateral displacement amount as the image writing position. The image forming unit 10 changes the image writing position according to the lateral displacement amount, and performs the image forming operation.

When the image forming apparatus 1 changes the image writing position, the convenience of the user is improved in, for example, the following case. For example, when it becomes necessary for the user to intentionally adjust the center position by mounting a finisher to the image forming apparatus 1, it is necessary to separately adjust the image writing position after the adjustment of the center position. According to the second embodiment shown in FIG. 12, the image forming apparatus 1 automatically adjusts the image writing position of the image forming unit 10 based on the lateral displacement change amount (difference of output values) before and after the adjustment of the center position. When the end of the pinion holder 206 is in the first area, the image forming apparatus 1 feedbacks the lateral displacement amount to the image writing position each time. The image forming apparatus 1 can accurately ensure the print position to the sheet without stopping the image forming operation. The image forming apparatus 1 may control to display information to urge correction of the center position on the control panel 40 when the lateral displacement amount exceeds the distance of the first area set by the user. The image forming apparatus 1 may control to output the information by sound.

In the first embodiment and the second embodiment, although the sensor to detect the pinion holder 206 is the non-contact photo interrupter sensor 209 using infrared rays or the distance measuring sensor 210, the sensor to detect the pinion holder 206 may be another non-contact sensor. The sensor to detect the pinion holder 206 may be a mechanical contact sensor. Although the photo interrupter sensor 209 and the distance measuring sensor 210 detect the pinion holder 206, the photo interrupter sensor 209 and the distance measuring sensor 210 may detect the front-side side wall 202F or the rear-side side wall 202R. The front-side side wall 202F or the rear-side side wall 202R may bend owing to the opening or closing of the sheet cassette 21 by the user. If the photo interrupter sensor 209 and the distance measuring sensor 210 detect the pinion holder 206, photo interrupter sensor 209 and the distance measuring sensor 210 more accurately detect the lateral displacement.

According to the first embodiment and the second embodiment, since the user can early recognize the lateral displacement of the pinion gear 205 and the pinion holder 206 in units of mm, the user can prevent occurrence of problems such as degradation of print position accuracy in the image forming apparatus 1 and jam occurrence.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a sheet stacker comprising:

a stacking table configured to stack a sheet, a pair of side walls configured to move symmetrically with respect to a center position to regulate both sides of the sheet in a width direction in parallel with an insertion direction of the stacking table, and a sensor configured to detect a relative position of the center position against the stacking table;

an image forming unit configured to form an image on the sheet;

a roller configured to convey the sheet on the stacking table to the image forming unit in a direction perpendicular to the width direction; and a notification unit configured to notify propriety of an image forming operation based on a displacement amount of the center position.

2. The apparatus of claim 1, wherein the pair of side walls moves in a same direction as an insertion direction of the sheet stacker.

3. The apparatus of claim 1, wherein the sheet stacker comprises a gear configured to regulate the center position.

4. The apparatus of claim 3, wherein the pair of side walls moves by way of the gear.

5. The apparatus of claim 3, wherein the pair of side walls and the gear comprises teeth of a same pitch.

6. The apparatus of claim 3, wherein the sheet stacker comprises a gear holder configured to position the gear relative to the stacking table.

7. The apparatus of claim 6, wherein the sensor detects a position of the gear holder.

8. The apparatus of claim 6, wherein the sensor detects a distance between the sensor and the gear holder.

9. The apparatus of claim 6, wherein the sheet stacker comprises at least one screw configured to fix the gear holder to the stacking table.

10. The apparatus of claim 6, wherein the gear holder comprises a projection to support the gear.

11. The apparatus of claim 10, wherein the gear rotates around the projection.

12. The apparatus of claim 1, wherein the sheet stacker comprises an end wall configured to regulate a trailing edge side of the sheet in a conveyance direction perpendicular to the width direction.

13. The apparatus of claim 1, wherein the notification unit displays information about the propriety of the image forming operation based on the displacement amount.

14. The apparatus of claim 1, wherein the image forming unit determines propriety of the image forming operation based on the displacement amount of the center position.

15. The apparatus of claim 14, wherein the image forming unit determines the propriety of the image forming operation upon detecting the center position by the sensor.

16. The apparatus of claim 14, wherein the image forming unit determines the propriety of the image forming operation upon inserting the sheet stacker.

17. The apparatus of claim 14, wherein the image forming unit changes an image writing position to the sheet according to the displacement amount.

18. A lateral displacement detection method, comprising:

stacking a sheet on a stacking table;

moving a pair of side walls symmetrically with respect to a center position to regulate both sides of a sheet;

detecting a relative position of the center position against the stacking table;

determining a displacement amount of the center position based on the relative position; and notifying propriety of an image forming operation based on a displacement amount of the center position.

19. A lateral displacement detection method, comprising:

stacking a sheet on a stacking table;

moving a pair of side walls symmetrically with respect to a center position to regulate both sides of a sheet;

detecting a relative position of the center position against the stacking table; and determining a displacement amount of the center position based on the relative position.

* * * * *